United States Patent [19]

Heuvelmans et al.

[11] Patent Number: 4,546,285

[45] Date of Patent: Oct. 8, 1985

[54] LOW-PRESSURE MERCURY VAPOR DISCHARGE LAMP

[75] Inventors: Jean J. Heuvelmans; Winston D. Couwenberg; Franciscus A. S. Ligthart, all of Eindhoven, Netherlands

[73] Assignee: U.S. Philips Corporation, New York, N.Y.

[21] Appl. No.: 720,653

[22] Filed: Apr. 8, 1985

Related U.S. Application Data

[63] Continuation of Ser. No. 646,043, Aug. 31, 1984, abandoned, which is a continuation of Ser. No. 307,715, Oct. 2, 1981, abandoned.

[30] Foreign Application Priority Data

Oct. 29, 1980 [NL] Netherlands ..... 8005921

[51] Int. Cl.[4] ..... H01J 61/12; H01J 61/20; H01J 61/34

[52] U.S. Cl. ..... 313/25; 313/490; 313/573; 313/642; 313/643

[58] Field of Search ..... 313/17, 490, 634, 642, 313/637, 643, 573, 25

[56] References Cited

U.S. PATENT DOCUMENTS

| | | | |
|---|---|---|---|
| 3,780,330 | 12/1973 | Otsuka et al. | 313/643 X |
| 4,093,889 | 6/1978 | Bloem et al. | 313/565 |
| 4,199,708 | 4/1980 | Lauwerijssen et al. | 313/220 X |
| 4,260,931 | 4/1981 | Wesselink et al. | 313/493 |
| 4,288,715 | 9/1981 | van Overveld et al. | 313/565 |
| 4,300,073 | 11/1981 | Skwirut et al. | 313/220 X |
| 4,337,414 | 6/1982 | Young | 313/220 X |
| 4,374,340 | 2/1983 | Bouwknegt et al. | 313/220 |

FOREIGN PATENT DOCUMENTS

| | | | |
|---|---|---|---|
| 0003555 | 3/1979 | Japan | 313/643 |

OTHER PUBLICATIONS

Geiss, Improvements in the Efficiency of Electric Incandescent Lamps, Phillips Technical Review, vol. 6, No. 11, Nov. 1941, pp. 334–342.

Thouret et al., Energy and Cost Saving Krypton Filled Incandescent Lamps, Journal of IES, Apr. 1975, pp. 188–197.

*Primary Examiner*—David K. Moore
*Assistant Examiner*—K. Wieder
*Attorney, Agent, or Firm*—Robert S. Smith

[57] ABSTRACT

Low-pressure mercury vapor discharge lamp having a curved discharge vessel in which a mercury discharge is maintained between the electrodes and in which furthermore an amlagam is provided to control the mercury vapor pressure, the discharge vessel containing a rare gas mixture which contains at least 50 at.% krypton at a pressure of 130 to 520 Pa.

11 Claims, 3 Drawing Figures

LOW-PRESSURE MERCURY VAPOR DISCHARGE LAMP

Figure 1:
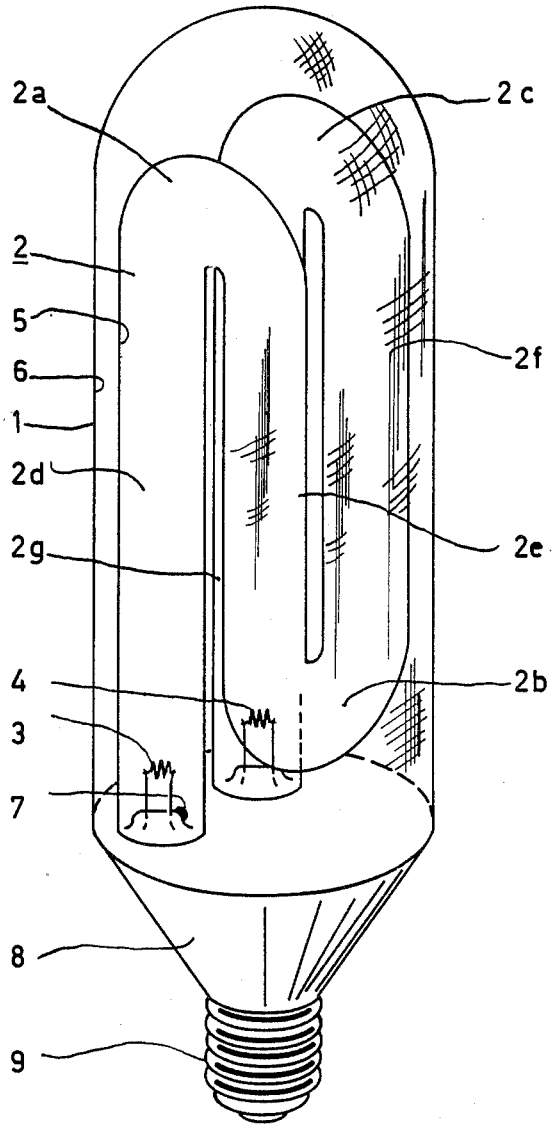

This is a continuation of application Ser. No. 646,043, filed Aug. 31, 1984, now abandoned, which is a continuation of application Ser. No. 307,715 filed Oct. 2, 1981, now abandoned.

The invention relates to a low-pressure mercury vapor discharge lamp having a discharge vessel which is closed in a vacuum-tight manner and contains mercury and at least one rare gas, electrodes being arranged one at each end of the said discharge vessel between which a discharge is maintained during operation of the lamp, the discharge vessel being shaped and dimensioned such that the discharge path is curved in one or more places, an amalgam further being provided in the discharge vessel for controlling the mercury vapor pressure in the discharge vessel, said lamp having a lamp base intended to be connected to a low-frequency a.c. line voltage. Such a lamp is disclosed in DE-OS No. 2,940,563).

A lamp described in the Offenlegungsschrift comprises a tubular discharge vessel which is curved in several places, a relatively long discharge path being formed between the electrodes during operation. The discharge vessel is surrounded by a glass envelope, the dimensions of the overall lamp being such that the lamp can be used as an alternative for an incandescent lamp for general lighting purposes.

The lamp further comprises an electric stabilization ballast which is positioned in a thin-walled lamp base connected to the envelope. A result of such a construction is that the heat generated during operation of the lamp in both the discharge vessel and in the stabilization ballast can only be dissipated comparatively poorly to the environment of the lamp. Added to this is the fact that the said compact discharge lamps are often positioned in luminares for incandescent lamps which are of such a shape that they surround the lamp for a considerable part. As a result the temperature in the discharge vessel may increase to a comparatively high value during operation of the lamp. In order to prevent the mercury vapor pressure from then exceeding a value which is the optimum value for the operation of the lamp (approximately 1 Pa), an amalgam is provided in the discharge vessel in the prior art lamp. By means of an amalgam the mercury vapor pressure in the discharge vessel is stabilized to the above-mentioned value over a comparatively wide temperature range. The presence of an amalgam has, however, the drawback that the mercury vapor pressure in the discharge vessel is significantly lower at comparatively low temperatures than the mercury vapor pressure in a discharge vessel which does not contain an amalgam. A result thereof is the ignition and reignition, respectively, of the lamp proceeds with difficulty in these circumstances.

In lamps operated from a line voltage supply having a comparatively low voltage (as for example, 110 V in U.S.A. or Japan) and having a quantity of argon in the discharge vessel in addition to mercury, a luminous flux comparable to a similar lamp operated from a 220 V line voltage can only be attained when the length of the lamp is reduced (the arc voltage between the electrodes at each end of the discharge vessel is then proportionately lower) and the current intensity through the lamp is increased. This means, however, that the efficiency of such a lamp and the (inductive) ballast together is not so good in comparison to lamps comprising said gas composition which are operated from 220 V. Added to this is the fact that particularly in lamps in which a tubular discharge vessel is folded to a U-shape in several places (it is, for example, folded to form a hook, as is described in the above-mentioned DE-OS) serious problems of a glass technological nature occur during folding during production of the lamp.

The invention has for its object to provide a lamp of the type defined in the preamble which can be manufactured in a comparatively simple way, which has a high luminous flux and starts easily. A low-pressure mercury vapor discharge lamp in accordance with the invention is accordingly characterized in that the said one rare gas is krypton and constitutes the sole rare gas or part of a rare gas mixture which contains at least 50 at.% krypton the krypton being at a pressure from 130 to 520 Pa.

It has surprisingly been found that such a rear gas mixture at a low mercury vapor pressure (and a comparatively low temperature) in the discharge vessel compared with a rare gas mixture containing predominantly argon results in a smooth ignition and reignition, respectively, of the lamp.

A lamp in accordance with the invention has the advantage that at low ambient temperatures of the lamp (for example below 10° C.) no repeated extinguishing and starting occurs on ignition (as is, for example, the case at those temperatures with a lamp having argon as a buffer gas). The said low mercury vapor pressure often occurs at low temperatures, particularly with lamps containing an amalgam in the discharge vessel. In addition, it has appeared that the luminous flux of lamps in accordance with the invention compared to the luminous flux of lamps whose discharge vessel comprises a mixture which, in addition to mercury, predominantly contained argon, is surprisingly very high (lamps with mixtures of rare gases with krypton usually had a low luminous flux), particularly when said lamps are operated from 90–130 V line voltages.

In a lamp in accordance with the invention in which the discharge part is curved, for example by folding a tubular discharge vessel a few times to form a hook which is enveloped by an envelope (see the DE-OS No. 2,940,563) it is possible to avoid during manufacture the folding of a very short discharge tube particularly intended for 100/120 V power line. Bending procedures of a glass-technologically troublesome nature in which the various end portions of the discharge tube pass as it were into each other are not necessary in the production of such short tubes. Lamps of this said shape in which the discharge tube has a length suitable for operation from a 220 V line voltage and is filled with argon, are suitable for operation from a 100/120 V line voltage while being of the same dimensions but containing krypton or a rare gas mixture, when the mixture contains at least 50 at.% of krypton. It has appeared that compared with lamps with an argon filling the efficiency of the lamp has surprisingly improved.

It has been found that at a relatively low vapor pressure it is desirable that the rare gas or gas mixture contains at least 50 at.% krypton to accomplish a smooth (re)-ignition of the lamp in accordance with the invention. It has namely, appeared that with lower percentages of krypton the re-ignition voltage at a low mercury vapor pressure in particular attains an excessively high value. A smooth ignition of a lamp is obtained with a rear gas mixture consisting of 75 at.% krypton and 25 at.% argon at a pressure of 267 Pa. In a preferred embodiment of a lamp in accordance with the invention the rare gas mixture predominantly contains krypton, that is to say the mixture consists exclusively of krypton but for traces of other rare gasses (such as argon, neon, helium). It has appeared that such a lamp not only has a surprisingly advantageous (re)ignition behavior at a low mercury vapor pressure and an advantageous efficiency (in combination with the ballast) but that also the operating life of the electrodes is influenced advantageously.

The invention will now be further described by way of example with reference to the accompanying drawings, which show schematically embodiments of a low-pressure mercury vapor discharge lamp in accordance with the invention.

Figure 2:
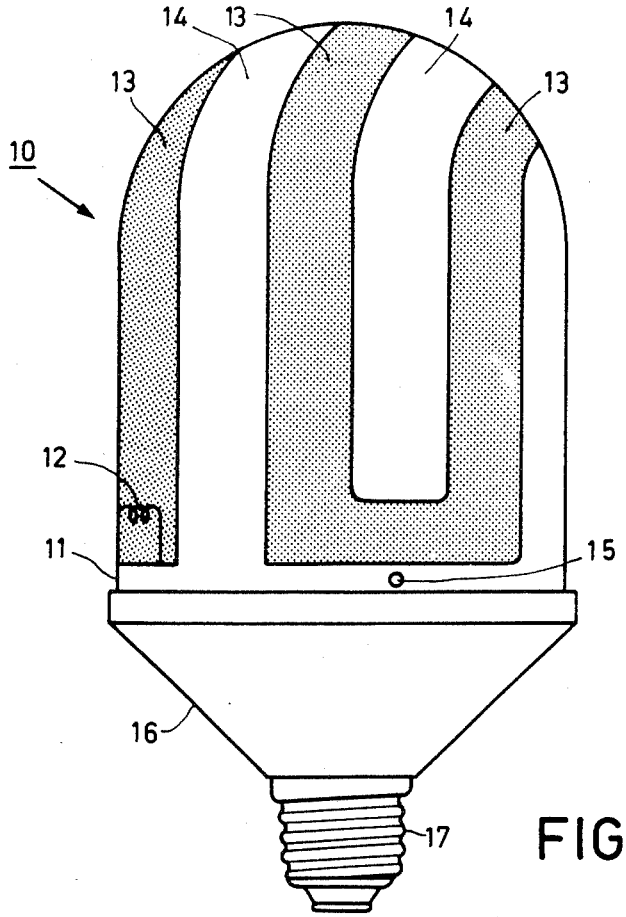
Figure 3:
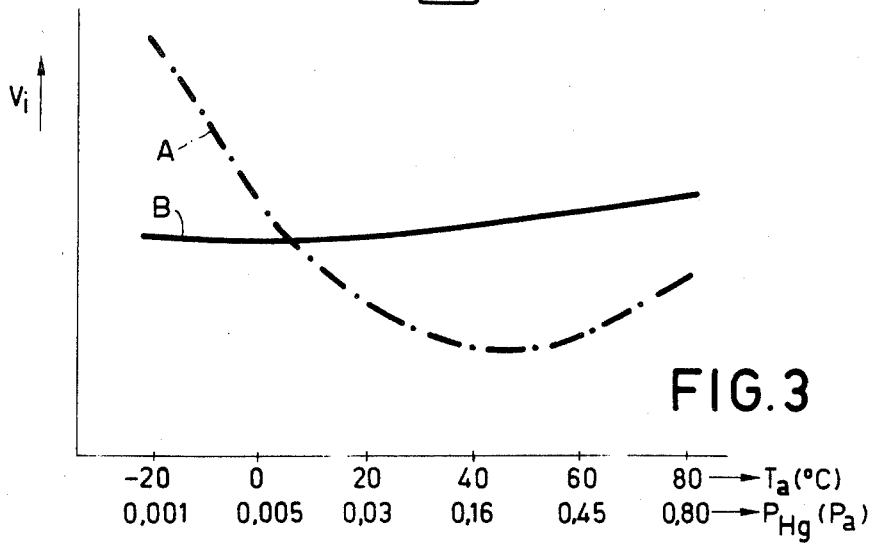

In the drawings:

FIG. 1 is an elevational view of a first embodiment of a lamp in accordance with the invention, FIG. 2 is an elevational view of a second embodiment of a lamp in accordance with the invention, and FIG. 3 is a graph of the ignition voltage and the re-ignition voltage, respectively, as a function of the mercury vapor pressure in the discharge vessel of a lamp shown in FIG. 1.

The lamp shown in FIG. 1 has a cylindrical glass lamp envelope 1 which at one end is closed in a somewhat hemi-spherical shape. A tubular discharge vessel 2, which is closed in a vacuum-tight manner, is arranged within this lamp envelope, the electrodes 3 and 4 being provided one at each end of the vessel. During operation of the lamp a discharge is maintained between these electrodes. The tubular discharge vessel is folded three times in a U-shaped manner. Four elongate straight portions 2*d* to 2*g* inclusive are present between the folded portions 2*a*, 2*b* and 2*c*. The tubular discharge vessel has the shape of a hook. From a glass-technological view it is comparatively simple to produce such a discharge vessel, as the elongate portions are present over a sufficient length between the folded portions.

A luminescent layer 5 which converts the ultraviolet radiation generated in the discharge into visible light is provided on the inner wall surface of the discharge vessel. The inner wall surface of the lamp envelope is provided with a light-dispersing layer of finely distributed titanium dioxide 6. At one end of the discharge vessel an amalgam 7 is provided on the wall to control the mercury vapor pressure. The amalgam consists of, for example, an alloy of indium, bismuth and mercury (see, for example, U.S. Pat. No. 4,157,485,) or of an alloy of lead, tin, bismuth and mercury (see, for example, U.S. Pat. No. 4,093,889,). The discharge vessel is filled with mercury and a rare gas mixture containing more than 50 at.% krypton at a pressure of 130 to 520 Pa for example 1.5 torr. The lamp is further provided with a thin-walled lamp base 8, which contains a glow-discharge starter and an inductive stabilization ballast. One end of this lamp base is connected to the lamp envelope and the other end has a generally conical shape and is provided with an Edison screw lamp cap 9, by means of which the lamp can be screwed into an incandescent lamp luminaire.

In a first practical embodiment of said lamp the overall length of the tubular discharge vessel (measured from electrode to electrode) was approximately 38 cm; the inside diameter was approximately 10 mm. The inside diameter of the glass envelope 1 was approximately 6.5 cm, the vapor pressure was stabilized over a range from 60°–110° C. (temperature in the region of the amalgam) at a constant value of approximately 1 Pa by means of an amalgam (consisting of In, Bi-Hg in a ratio in atoms of 45:49:6). When a power of 18 W (118 V AC 60 Hz) was applied to the lamp (including the ballast), the luminous flux was approximately 900 lm with a filling of substantially pure krypton at a pressure of 267 Pa. The luminescent layer provided on the inner wall surface of the discharge vessel consisted of a mixture of two phosphors, namely green-luminescing terbium-activated cerium magnesium aluminate and red-luminescing trivalent-europium activated yttrium oxide.

In a second practical embodiment of said lamp the electrode spacing was 34 cm and the inside diameter of the tubular discharge vessel was 10 mm. Using a Hg-Bi-Sa-Pb amalgam, in a ratio in atoms of 6:45:23:26) the same phosphors and the same mains voltage (118 V, 60 Hz) the luminous flux was 600 lm when a power of 12 W was applied to the lamp (the ballast included). In addition to mercury, the discharge vessel was filled with a rare gas mixture substantially exclusively consisting of krypton at a pressure of 334 Pa.

In the third embodiment (electrode spacing 42 cm, inside diameter 10 mm) the luminous flux was 1200 lm in the same circumstances as for the above-mentioned lamp, a power of 25 W being applied (ballast included). The rare gas in the discharge vessel was krypton at a pressure of 200 Pa.

In a fourth embodiment (electrode spacing 39 cm, inside diameter 12 mm) the luminous flux was 900 lm with the said phosphors and the said In-Bi amalgam, a power of 17 W, 118 V, 60 Hz being applied to the lamp (the ballast included). The discharge vessel contained krypton at a pressure of 200 Pa.

In a fifth embodiment (electrode spacing 34 cm, inside diameter 10 mm) the luminous flux was 900 lm, the same phosphors and the said In-Bi amalgam being used, a power of 18 W (110 V) being applied to the lamp (the ballast included). The rare gas mixture was composed of 75 at.% krypton and 25 at.% argon at a pressure of 267 Pa.

In a sixth embodiment of the said lamp the filling was a rare gas mixture consisting of 50 at.% krypton and 50 at.% Argon (267 Pa) (electrode spacing 35 cm, inside diameter 12 mm, all the other circumstances being the same as for the fourth embodiment). The luminous flux was 900 lm at an applied power of 18 W, (the ballast included).

The essentials of the lamp shown in FIG. 2 are described in DE-OS No. 2,904,864. It comprises a discharge vessel which is limited by the wall of a spherically-closed cylindrical thin-walled glass outer member 10, and a spherically-closed thin-walled glass inner member, which is enveloped by 10. Near their edges (in the region of 11) both members are sealed together in a gas-tight manner.

In the outer wall surface of the inner member there is a meander-shaped groove. The groove is of such a shape that the discharge path (which is defined by the groove wall and the portions of the inner wall surface of the outer member which are located opposite the groove) between the electrodes is curved by folding in a number of places. Only one electrode, namely electrode 12, is shown in the drawing. Only the wall portions of the two members which define the discharge path are coated with a layer of luminescent material. Said wall portions are the dark portions 13 in the drawing. The portions of the inner member located between the groove portions, and also the wall portions of the outer member which are located opposite said wall-portions are free of luminescent material. Through these "windows" 14 light directed in the direction of the longitudinal axis of the lamp can pass. In accordance with the invention, mercury and a rare gas mixture, predominantly containing krypton, are present in the discharge vessel of this lamp. An amalgam 15 consisting of mercury, indium and bismuth is provided near the sealing edge 11 of the two members. This amalgam is provided in an indentation in the wall of the inner member. It is in connection with the mercury discharge through a narrow, channel space provided between these two members. However, this channel is dimensioned such that no short circuiting of the discharge occurs between the several groove portions. The lamp furthermore has a thin-walled lamp base 16 (in which there are, for example, an electric stabilisation ballast and a starter) and an Edison lamp cap 17, so that the lamp can be fitted in a luminaire for incandescent lamps.

In FIG. 3 the (re) ignition voltage $V_i$ of a lamp shown in FIG. 1 is plotted (in an arbitrary unit) on the Y-axis and on the X-axis there is plotted the mercury vapor pressure $P_{Hg}$ in the discharge vessel (and the amalgam temperature $T_a$ corresponding therewith of an amalgam consisting of indium, bismuth and mercury, composition 45:49:6). Curve A shows the behaviour of the (re) ignition voltage as a function of the mercury vapor pressure for the said lamps containing argon (400 Pa) as a buffer gas and Curve B shows said behavior when substantially pure krypton (200 Pa) is used as the buffer gas. From the graph it appears that the behavior of the (re)ignition voltage for lamps containing krypton (Curve B) at an (amalgam) temperature below approx. 5° C. (and $P_{Hg}$ lower than 1 Pa, respectively) is more advantageous than with lamps containing argon (Curve A). In contrast therewith, at a higher mercury vapor pressure the variation of the (re) ignition voltage of lamps containing argon is more advantageous, but the difference is less pronounced than at a low vapor pressure.

Particularly, when used in comparatively cool places the (re) ignition behaviour of a lamp containing amalgam and rare gas mixtures in accordance with the invention is more advantageous than for a lamp having amalgam and argon as a buffer gas.

What is claimed is:

1. A low-pressure mercury vapor discharge lamp having a discharge vessel which is closed in a vacuum-tight manner and contains mercury and at least one rare gas, electrodes being arranged one at each end in said discharge vessel between which a discharge is maintained during operation of the lamp, the discharge vessel being shaped and dimensioned such that the discharge path is curved in one or more places, an amalgam further being provided in the discharge vessel to control the mercury vapor pressure in the discharge vessel, said lamp having a lamp base intended for connection to a low-frequency a.c. line voltage, said one rare gas being krypton and constitutes the sole rare gas or part of a rare gas mixture which contains at least 50 at.% krypton, the krypton being at a pressure from 130 to 520 Pa, said discharge path being surrounded by a glass wall of said discharge vessel which has an inner diameter which is between 10 and 12 mm.

2. A low-pressure mercury vapor discharge lamp as claimed in claim 1, characterized in that the rare gas mixture contains 75 at.% krypton and 25 at.% argon.

3. A low-pressure mercury vapor discharge lamp as claimed in claim 1, characterized in that the rare gas mixture predominantly contains krypton.

4. A low-pressure mercury vapor discharge lamp as claimed in claim 1, characterized in that the lamp is intended for connection to an a.c. voltage supply mains having a voltage from 90–130 volts.

5. A low-pressure mercury vapor discharge lamp as claimed in claim 1, characterized in that the discharge vessel is tubular and has been folded in a U-shape in three places to form a hook, the inside diameter of the discharge vessel being from 10–12 mm, the discharge vessel being surrounded by an envelope.

6. A low-pressure mercury vapor discharge lamp as claimed in claim 2, characterized in that the discharge vessel is tubular and has been folded in a U-shape in three places to form a hook, the inside diameter of the discharge vessel being from 10–12 mm, the discharge vessel being surrounded by an envelope.

7. A low-pressure mercury vapor discharge lamp as claimed in claim 3, characterized in that the discharge vessel is tubular and has been folded in a U-shape in three places to form a hook, the inside diameter of the discharge vessel being from 10–12 mm, the discharge vessel being surrounded by an envelope.

8. A low-pressure mercury vapor discharge lamp as claimed in claim 4, characterized in that the discharge vessel is tubular and has been folded in a U-shape in three places to form a hook, the inside diameter of the discharge vessel being from 10–12 mm, the discharge vessel being surrounded by an envelope.

9. A low-pressure mercury vapor discharge lamp as claimed in claim 2, characterized in that the lamp is intended for connection to an a.c. voltage supply mains having a voltage from 90–130 volts.

10. A low-pressure mercury vapor discharge lamp as claimed in claim 3, characterized in that the lamp is intended for connection to an a.c. voltage supply mains having a voltage from 90–130 volts.

11. A low-pressure mercury vapor discharge lamp comprising a lamp base intended for connection to a low frequency AC line voltage, and a discharge vessel, said discharge vessel comprising a transparent elongated wall which is closed in a vacuum-tight manner and contains mercury and at least one rare gas; respective electrodes arranged one at each end of the elongated wall in said discharge vessel, between which electrodes a discharge is maintained along a path during operation of the lamp; and an amalgam provided in the discharge vessel to control mercury vapor pressure during operation of the lamp; said discharge vessel being shaped such that the discharge path is curved in at least one place, characterized in that said at least one rare gas is at least 50 at.% krypton, said krypton being at a pressure between approximately 130 and 520 Pa, and said elongated transparent wall is a tubular wall having an inner diameter of approximately 12 mm maximum.

* * * * *